US010404021B2

(12) United States Patent
Jeon et al.

(10) Patent No.: US 10,404,021 B2
(45) Date of Patent: Sep. 3, 2019

(54) RELIABLE CONNECTOR RECEPTACLES HAVING HIGH SIGNAL QUALITY

(71) Applicant: Apple Inc., Cupertino, CA (US)

(72) Inventors: James M. Jeon, Cupertino, CA (US); Mahmoud R. Amini, Sunnyvale, CA (US); Ruihua Ding, Cupertino, CA (US); Alex Le Roux, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 180 days.

(21) Appl. No.: 15/274,354

(22) Filed: Sep. 23, 2016

(65) Prior Publication Data

US 2018/0090884 A1 Mar. 29, 2018

(51) Int. Cl.

| | |
|---|---|
| ***H01R 13/6471*** | (2011.01) |
| ***H01R 24/60*** | (2011.01) |
| ***H01R 12/72*** | (2011.01) |
| ***H01R 13/05*** | (2006.01) |
| ***H01R 13/26*** | (2006.01) |

(52) U.S. Cl.

CPC ..... *H01R 24/60* (2013.01); *H01R 13/05* (2013.01); *H01R 13/26* (2013.01); *H01R 12/724* (2013.01); *H01R 13/6471* (2013.01); *H01R 2201/06* (2013.01)

(58) Field of Classification Search

CPC .. H01R 13/6471; H01R 13/05; H01R 12/714; H01R 24/60; H01R 2201/06

See application file for complete search history.

(56) References Cited

U.S. PATENT DOCUMENTS

2012/0063726 A1* 3/2012 Wu ..... G02B 6/3817 385/88

2013/0316568 A1* 11/2013 Yu ..... H01R 24/60 439/485

* cited by examiner

*Primary Examiner* — Briggitte R. Hammond

(74) *Attorney, Agent, or Firm* — Kilpatrick Townsend & Stockton, LLP

(57) ABSTRACT

Connector receptacles and connector inserts that may be reliable, may readily manufactured, and may provide high signal quality for high speed signals with minimized signal noise, distortion losses, radiation, and interference. An example may provide a reliable connector receptacle by including a plurality of contacts, where each contact includes a first bend angling a contacting portion away from a tongue and a second bend angling a contacting portion towards the tongue, where the second bend is between the first bend and a front of the connector receptacle. Another example may provide a connector receptacle that may be readily manufactured by providing a tongue having tapered lead-ins for receiving contacting portions of contacts during assembly. Another example may provide a connector receptacle that provides isolation among signals by arranging through-hole portions of signal contacts in lines that are separated from each other by intervening through-hole portions of ground contacts.

19 Claims, 21 Drawing Sheets

RELIABLE CONNECTOR RECEPTACLES HAVING HIGH SIGNAL QUALITY

BACKGROUND

Power and data may be provided from one electronic device to another over cables that may include one or more wire conductors, fiber optic cables, or other conductors. Connector inserts may be located at each end of these cables and may be inserted into connector receptacles in the communicating or power transferring electronic devices.

Users may insert these connector inserts into connector receptacles many times. Occasionally, such an insertion may damage a connector receptacle. Such damage to the connector receptacle may reduce the functionality of the electronic device housing the connector receptacle. In a worst-case situation, such damage may render the electronic device inoperable. Accordingly, it may be desirable that these connector receptacles may be reliable and able to withstand a large number of insertions by connector inserts.

Various electronic devices may generate a large demand by consumers. Yield problems may impair a manufacturer's ability to deliver the electronic devices to fill this demand. Accordingly, it may be desirable to provide connector receptacles that may be readily manufactured.

Also, contacts in a connector receptacle may convey high-speed signals along with power supplies and other signals. Connector structure can contribute signal noise, distortion and losses due to the fast rising/falling edges of the high speed signals. At high bit rates, these effects can degrade the electrical signal to the point when errors occur and system or device fails. Also, high-speed signals may generate electromagnetic interference (EMI) and radiation, which may couple to other devices and circuits in or associated with the electronic device. Accordingly, it may be desirable to provide connector receptacles that are less susceptible to EMI and have a high signal quality.

Thus, what is needed are connector receptacles that may be reliable, may readily manufactured, and may provide high signal quality for high speed signals with minimized signal noise, distortion losses, radiation, and interference.

SUMMARY

Accordingly, embodiments of the present invention may provide connector receptacles that may be reliable, may readily manufactured, and may provide high signal quality for high speed signals with minimized signal noise, distortion losses, radiation, and interference.

An illustrative embodiment of the present invention may provide a reliable connector receptacle that is less susceptible to damage during an insertion of a connector insert. In some connector receptacles, a contact may lift or separate from a supporting tongue. The contact may then be bent when a front edge of the contact is engaged by a connector insert when the connector insert is inserted into the connector receptacle. Accordingly, embodiments of the present invention may provide connector receptacles that may include a number of contacts having contacting portions to mate with corresponding contacts in a connector insert, where the contacting portions may be formed to be bent or angled at one or more positions along their lengths. For example, a first bend may angle the contacting portion away from a supporting tongue and a second bend may angle the contacting portion towards the tongue. The second bend may be between the first bend and a front of the tongue and connector insert. This double-bend arrangement may increase an angle of the contacting portion relative to the tongue near a front of the tongue. This increased angle may help to prevent the separation of the contacting portion of a contact from a supporting tongue, thereby improving reliability of the connector receptacle. More specifically, the increased angle may provide a pre-bias force on the contacting portion pushing against the tongue. This pre-bias force may help to prevent the contacting portion from separating from the tongue, which may prevent the contacting portion from being bent when a connector insert is inserted into the connector receptacle.

Another illustrative embodiment of the present invention may provide a connector receptacle that is readily manufactured. A connector receptacle may include a housing having a tongue, where the tongue may be formed separately from the housing or as part of the housing. A rear of the tongue may include a number of openings, each for a corresponding one of a number of contacts. The rear openings may have tapered lead-ins to prevent contacting portions of the contacts from stubbing against the rear of the tongue when the contacts are inserted onto the tongue.

Another illustrative embodiment of the present invention may provide a connector receptacle that may provide high signal quality for high speed signals with minimized signal noise, distortion, losses, radiation, and interference. For example, through-hole contact portions of signal contacts may be arranged in lines that are separated from each other by intervening through-hole contact portions of ground contacts. A housing for the connector receptacle may be shielded with a top and a bottom shield. Also, the through-hole contact portions for its contacts may be arranged in an array, where the array has rows of tabs on each for four sides, the tabs connected to the top and bottom shields and arranged to fit in openings in a printed circuit board or other appropriate substrate to form ground connections.

In these and other embodiments of the present invention, power supply and signal contacts may include through-hole contact portions. These through-hole contact portions may fit in openings in a printed circuit board or other appropriate substrate to form electrical connections with traces in the printed circuit board or other appropriate substrate. These through-hole contact portions may also provide mechanical stability for the combined connector receptacle. In other embodiments of the present invention, some or all of the contacts may terminate in surface-mount contacting portions.

While embodiments of the present invention may be useful in HDMI connector receptacles, these and other embodiments of the present invention may be used in other types of connector inserts and connector receptacles for different interfaces.

In various embodiments of the present invention, contacts, shields, EMI or ground contacts, beams, cross-beams, and other conductive portions of a connector receptacle or connector insert may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, rear housings, tongues, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material. Printed circuit boards may be replaced by other substrates, such as flexible circuit boards, in many embodiments of the present invention.

Embodiments of the present invention may provide connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
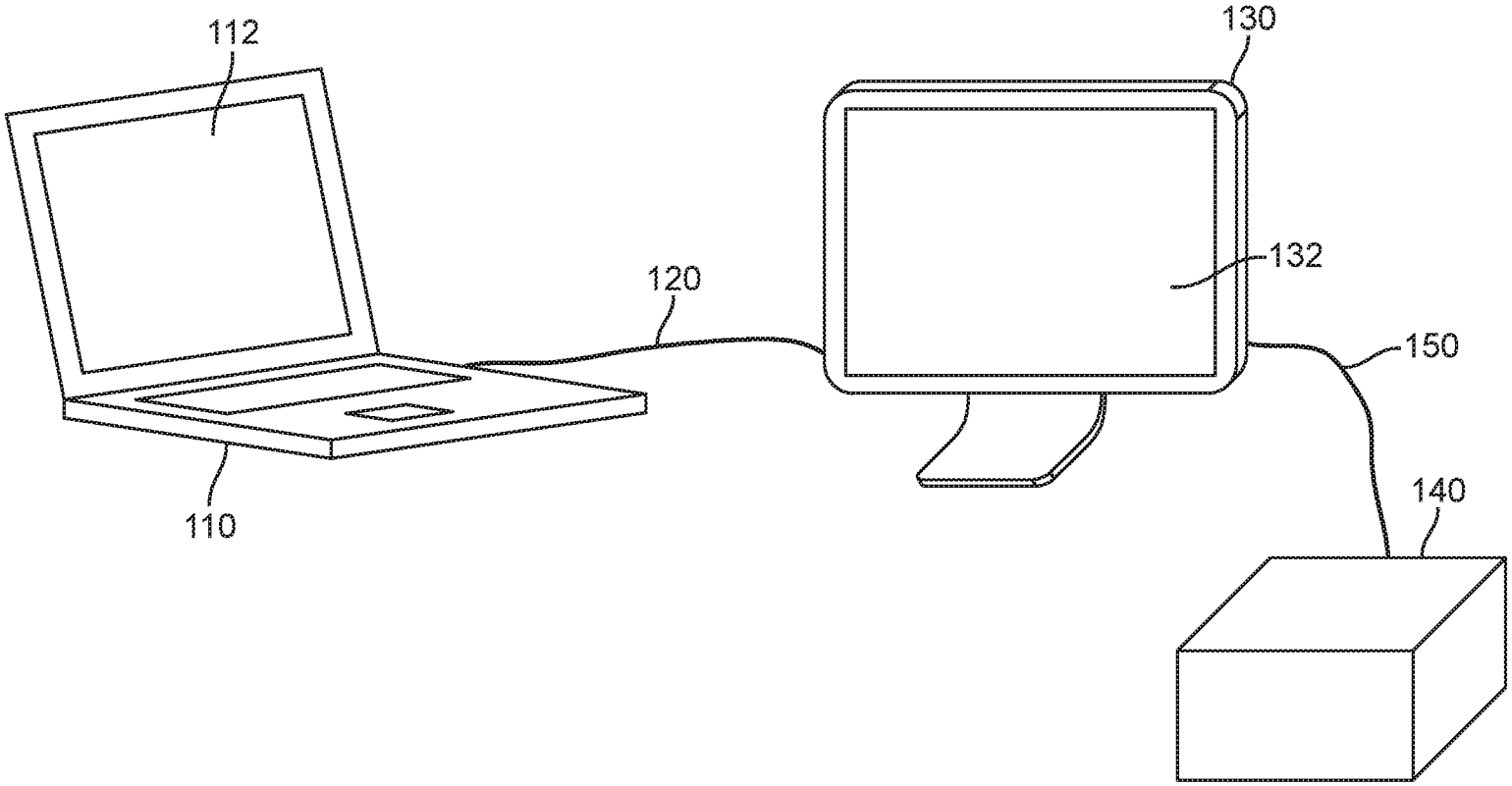
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates a monitor 130 that may be driven by one of two sources, specifically computer 110 or set-top box 140. Computer 110 may provide video data over cable 120 to monitor 130. Video data may be displayed on the video screen 132 of monitor 130. Computer 110 may similarly include a screen 112. Set-top box 140 may provide video data over cable 150 to monitor 130. Again, this video data may be displayed on screen 132 of monitor 130. In other embodiments the present invention, other types of devices may be included, and other types of data may be shared or transferred among the devices. For example, monitor 130 may be a monitor, an all-in-one computer, tablet computer, or other device having screen 132. In these and other embodiments of the present invention, power may be shared among computer 110, monitor 130, and set-top box 140 over cables 120 and 150.

Cables 120 and 150 may be various types of cables. For instance, they may be HDMI, Thunderbolt, DisplayPort, USB Type-C, or other types of cables. These cables may include connector inserts (not shown) that plug into connector receptacles (not shown) on the computer 110, monitor 130, and set-top box 140.

These connector receptacles may become damaged when connector inserts attached to cables 120 and 150 are inserted into them. For example, an HDMI connector receptacle may include a tongue supporting contacting portions of a number of contacts. One or more of these contacting portions may lift or separate from the supporting tongue. The separated contacting portion may engage a connector insert as it is inserted into the connector receptacle. This may cause the contacting portion to become bent or damaged. This damage may render the device at least partially inoperable. Accordingly, embodiments of the present invention may provide reliable connector receptacles. Examples are shown in the following figures.

Figure 2:
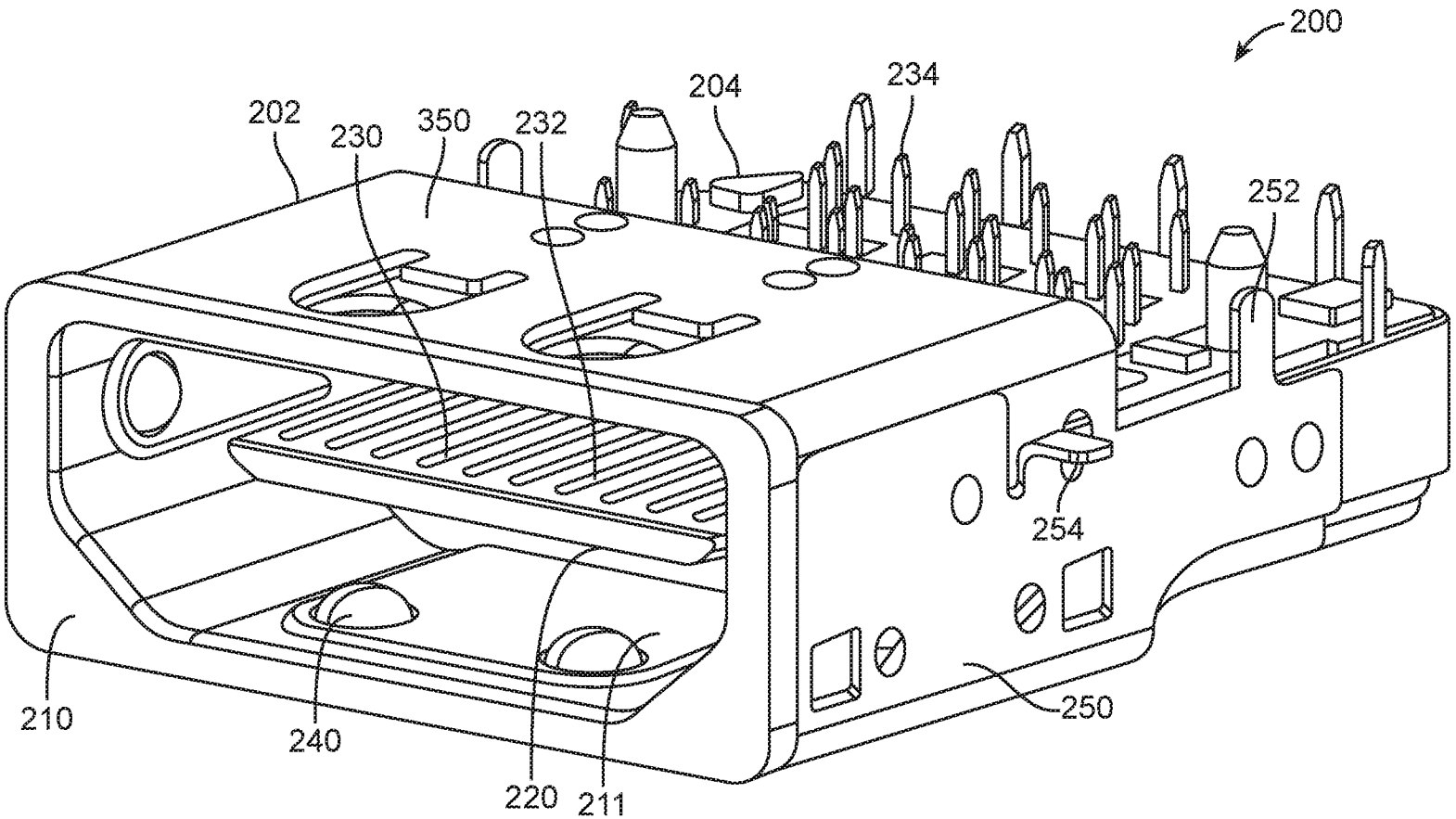
FIG. 2 illustrates a connector receptacle according to an embodiment of the present invention.

FIG. 2 illustrates a connector receptacle according to an embodiment of the present invention. Connector receptacle 200 may include housing 210 having opening 211. Tongue 220 may be located in an opening 211. Tongue 220 may support a number of contacts 230 having contacting portions 232. A number of EMI or ground contacts 240 may be located on the inside surface of housing 210 in opening 211. Top shield 250 may at least partially surrounded housing 210. Top shield 250 may include tabs 252. Tabs 252 may be inserted into openings in a printed circuit board to form ground connections. Top shield 250 may further include side tabs 254. Side tabs 254 may reside on, and be attached to, a top surface of a printed circuit board for mechanical support. Bottom shield 350 may cover a bottom portion housing 210 (which is shown at the top in this figure.) Contacts 230 may include through-hole contact portions 234.

Connector receptacle 200 may include a front portion 202 and a rear portion 204. Rear portion 204 may include tabs 252 and through-hole contact portions 234 for mating with a printed circuit board. Front portion 202 of connector receptacle 200 may reside at an edge or in a U-shaped notch in an edge of a printed circuit board. Again, side tab 254 may reside on a surface of a printed circuit board for alignment and mechanical purposes. Side tab 254 may further be soldered to a pad or contact on a surface of a printed circuit board (not shown) for grounding and mechanical support.

While embodiments of the present invention are well-suited to connector receptacles, tongue 220 may be a tongue of a connector insert. Where tongue 220 is a tongue of a connector insert, remaining portions of housing 210 may be omitted.

Figure 3:
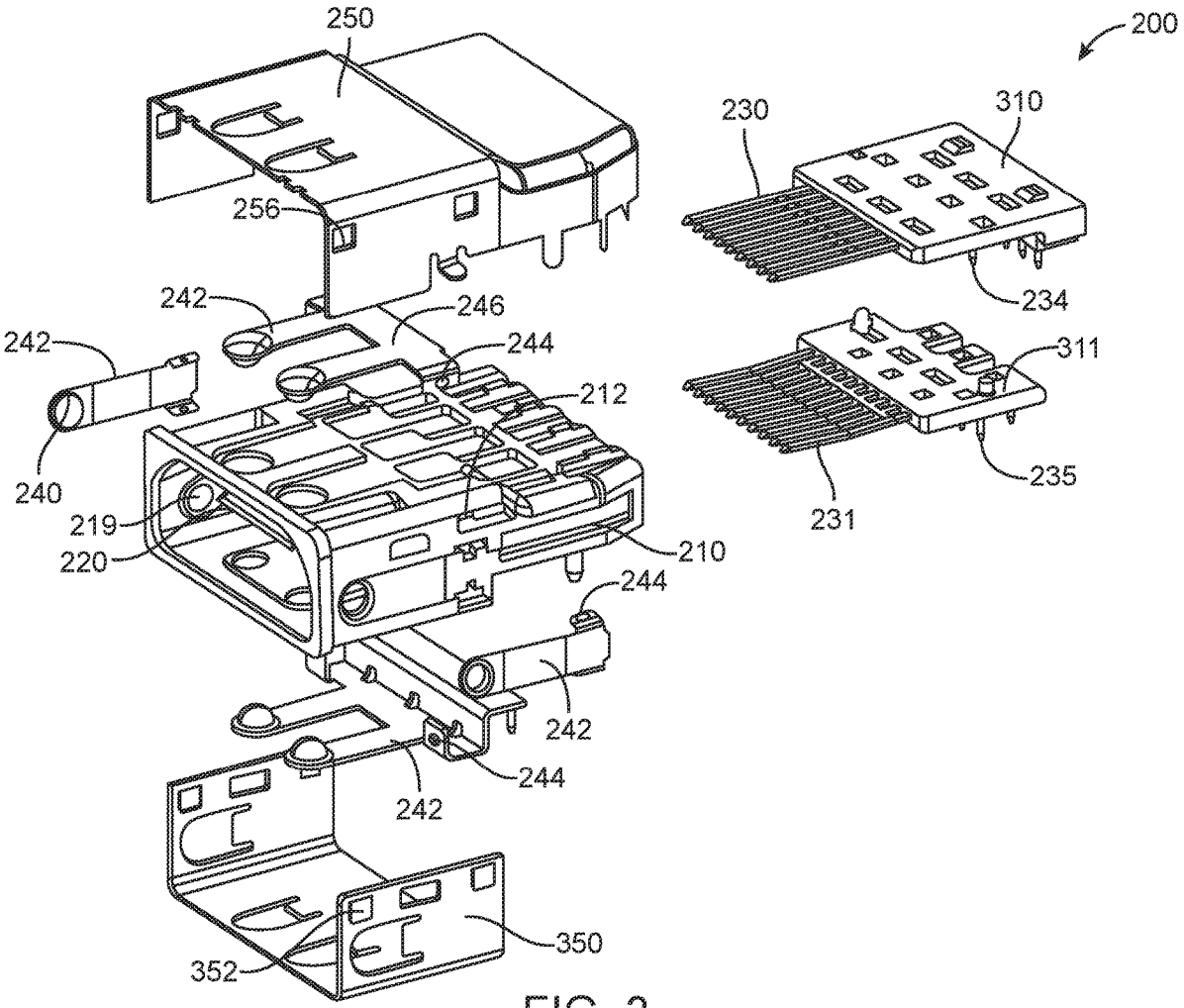
FIG. 3 is an exploded view of a connector receptacle according to an embodiment of the present invention.

FIG. 3 is an exploded view of a connector receptacle according to an embodiment of the present invention. Connector receptacle 200 may include housing 210 supporting tongue 220. Tongue 220 may be formed with housing 210 as a single piece, or tongue 220 may be formed separately from other portions of housing 210. EMI or ground contacts 240 may be aligned with openings 219 in housing 210. EMI or ground contacts 240 may be supported by beams 242. Beams 242 may include tabs 244 that may be inserted into slots 212 in housing 210. Two or more beams 242 may be joined by crossbeams 246.

Bottom shield 350 may be fit over a bottom portion of housing 210. Top shield 250 may be fit over bottom shield 350 and housing 210. Openings 256 on top shield 250 may engage tabs 352 on bottom shield 350 to secure top shield 250 and bottom shield 350 together. Top shield 250 and bottom shield 350 may also be spot or laser welded to each other and to beams 242 and cross bars 246. Contacts 230 may include through-hole contact portions 234 and may be at least partially housed in first rear housing 310. Contacts 231 may similarly include through-hole contact portions 235 and may be at least partially housed in second rear housing 311. Contacts 230 and 231 may be collectively referred to as contacts 230, through-hole contact portions 234 and 235 may be collectively referred to as through-hole contact portions 234, and rear housing portions 310 and 311 may be collectively referred to as housings 310, for simplicity.

Connector receptacle 200 may be manufactured in very large numbers. Accordingly, embodiments of the present invention may provide connector receptacles that may be readily manufactured. Examples are shown in the following figures.

Figure 4:
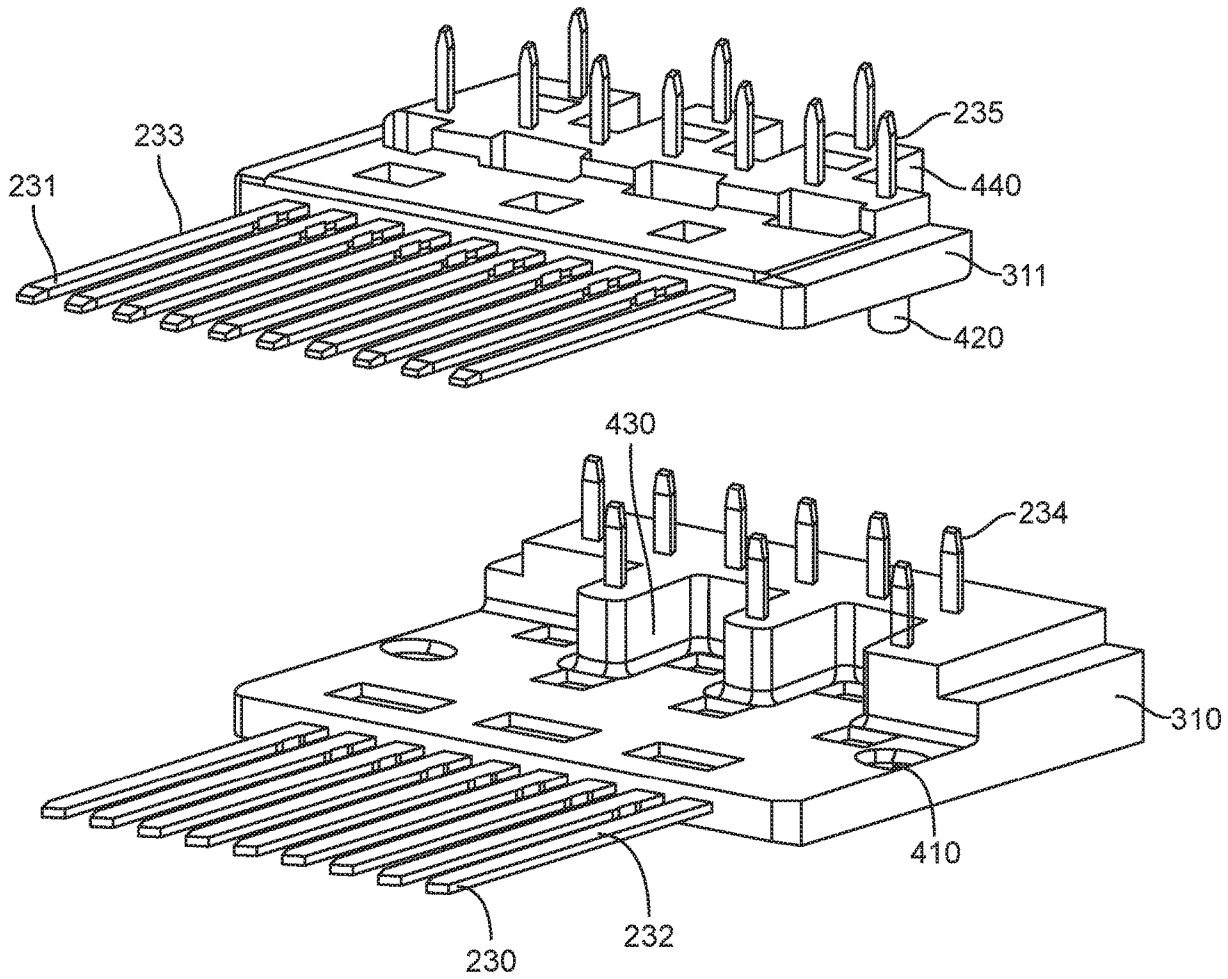
FIGS. 4-10 illustrates steps in the manufacturing of a connector receptacle according to an embodiment of the present invention.

FIGS. 4-10 illustrate steps in the manufacturing of a connector receptacle according to an embodiment of the present invention. In FIG. 4, posts 420 of rear housing 311 may be inserted into openings 410 in housing 310. Features 430 of rear housing 310 may fit in features 440 of rear housing 311 to secure rear housings 310 and 311 to each other. Rear housing 311 may support a number of contacts 231 having contacting portions 233 and through-hole contact portions 235. Rear housing 310 may support a number of contacts 230 having contacting portions 232 and through-hole contact portions 234. Rear housing portions 310 and 311 may be formed by insert molding or other step. Rear housing portions 310 and 311 may be formed around at least middle portions of contacts 230 and 231.

Figure 5:
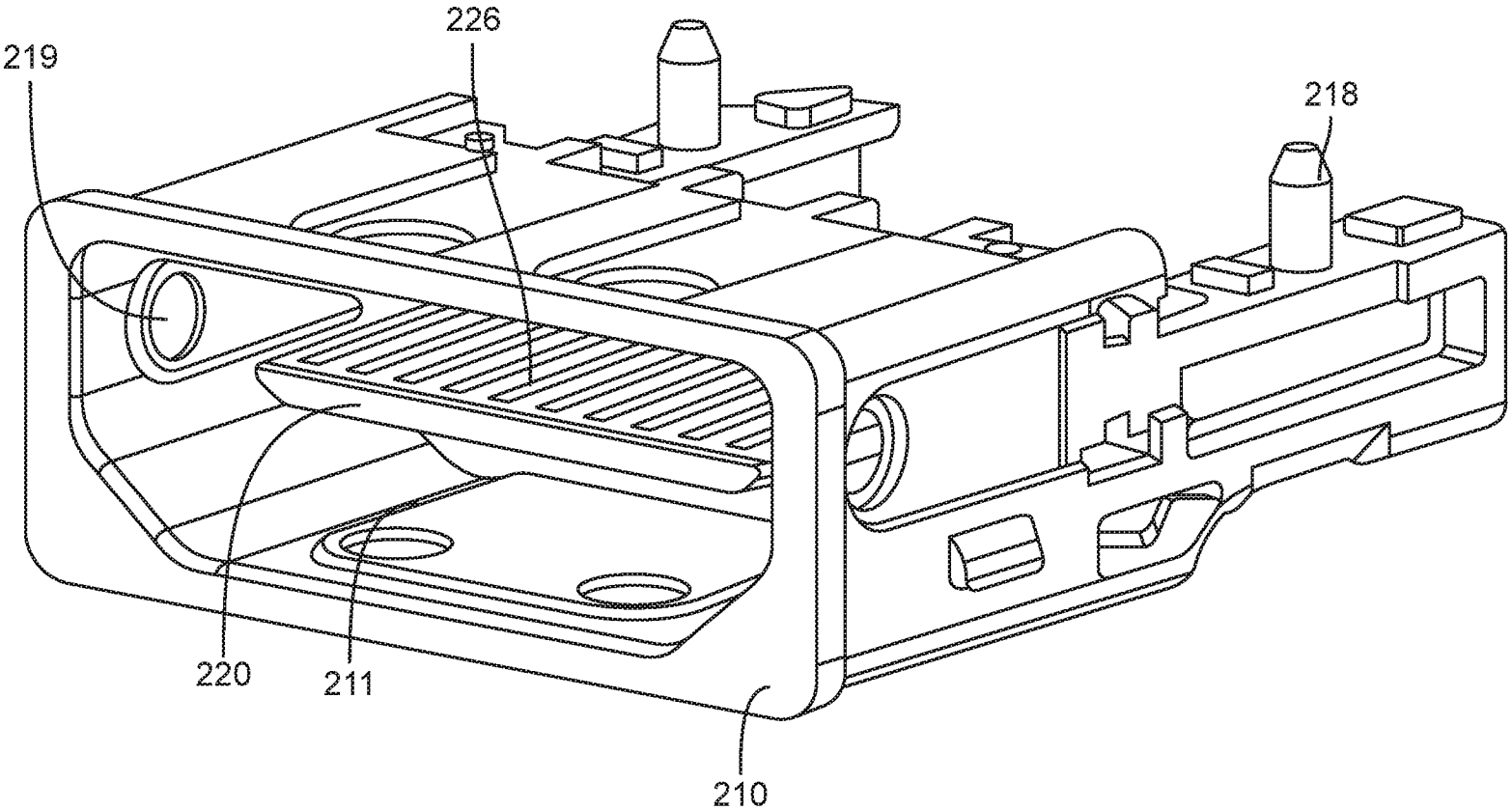
Figure 6:
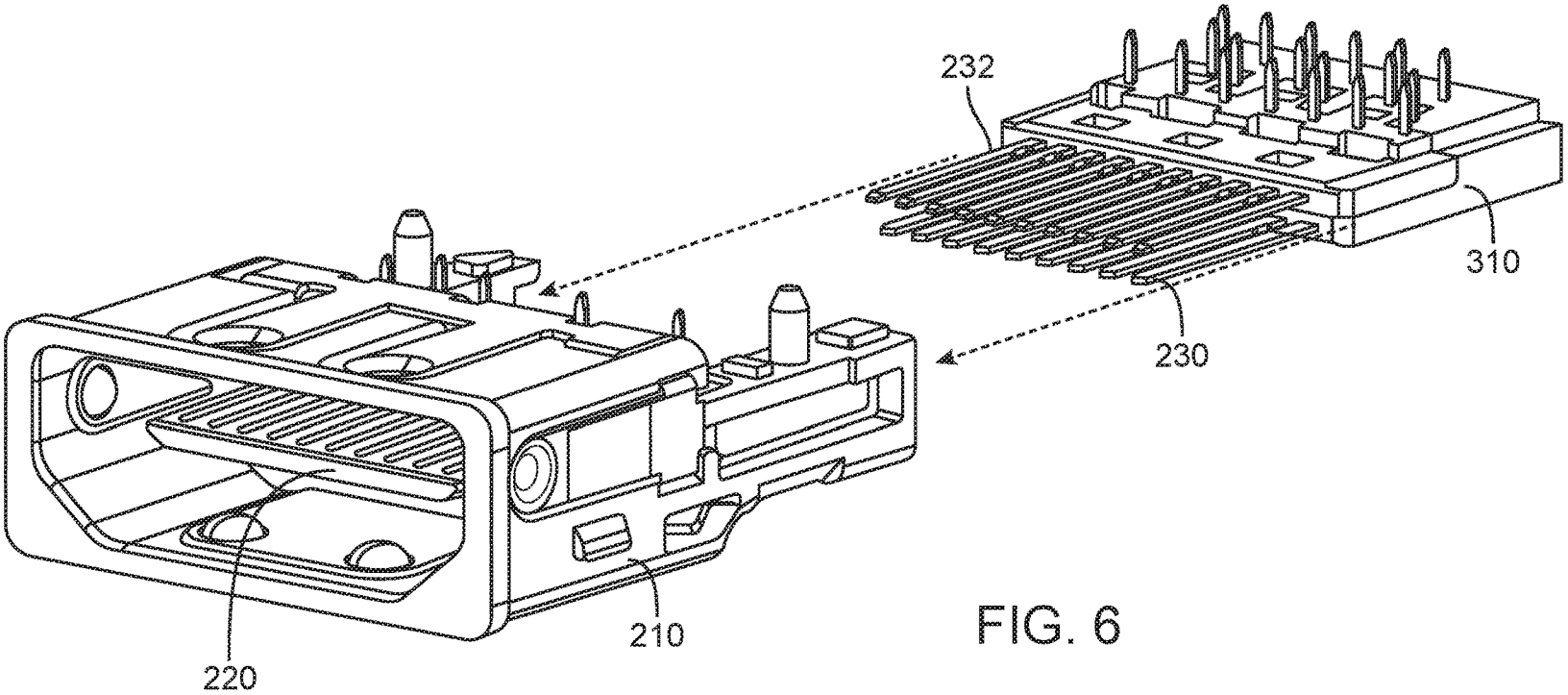
Figure 7:
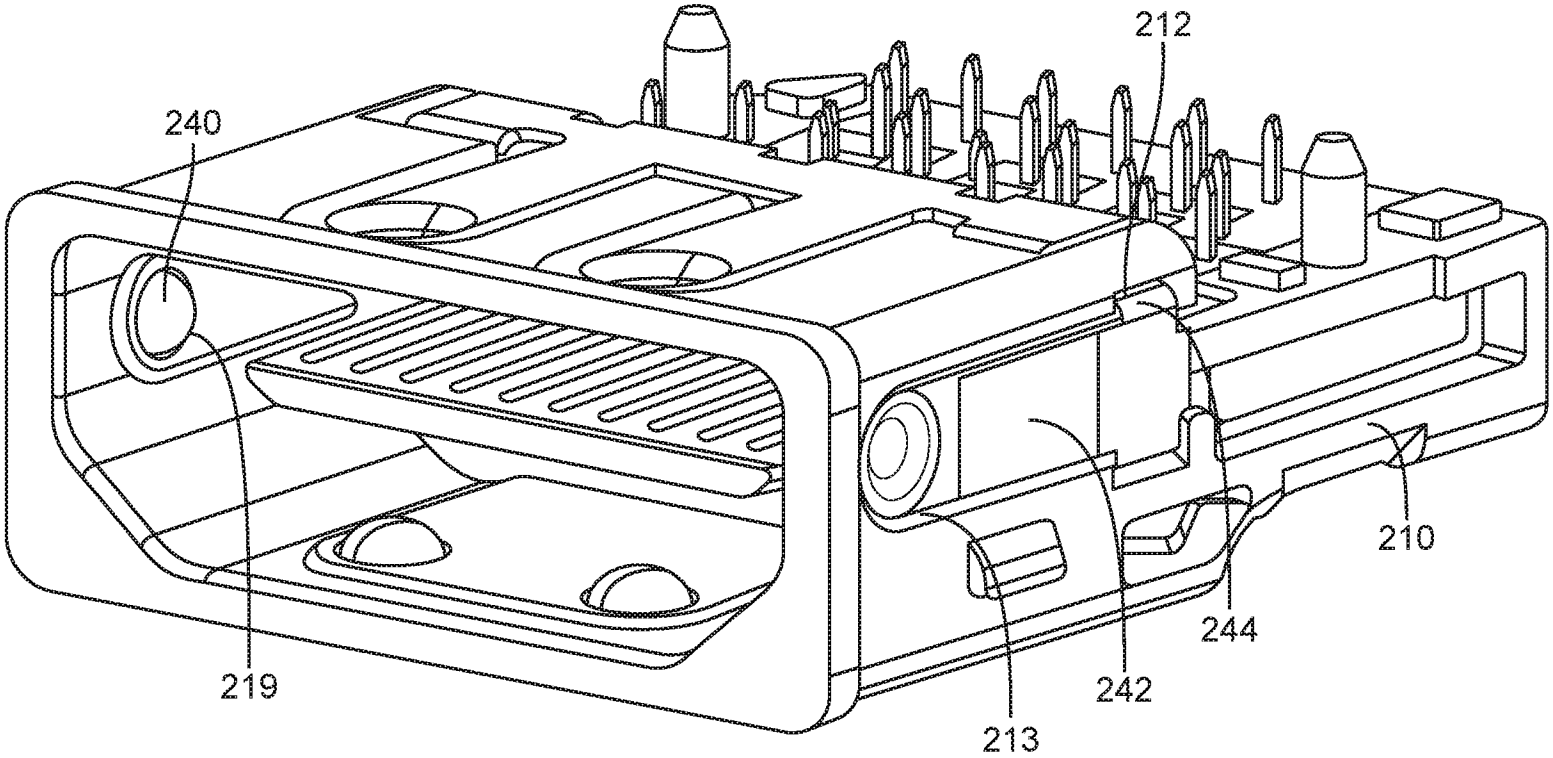

In FIG. 5, housing 210 may be provided. Housing 210 may include tongue 220 in opening 211. Openings 219 may be located in sides of housing 210 to provide passageways for EMI or ground contacts 240 (shown in FIG. 3). Tongue 220 may include a number of slots 226 on its top side and bottom side (not shown) for supporting a number of contacts (not shown). Housing 210 may include posts 218. Posts 218 may be inserted into openings in a printed circuit board or other appropriate substrate for alignment and mechanical strength. In FIG. 6, the assembled rear housings, collectively referred to as housings 310, may be inserted into a rear of housing 210. Contacting portions 232 of contacts, collectively referred to herein as contacts 230, may be inserted into slots 226 (shown in FIG. 6) on tongue 220 of housing 210. In FIG. 7, EMI or ground contacts 240 may be aligned with openings 219 in housing 210. Beams 242 may be inserted into notches 213 in sides of housing 210. Tabs 244 may be inserted into slots 212 in housing 210.

Figure 8:
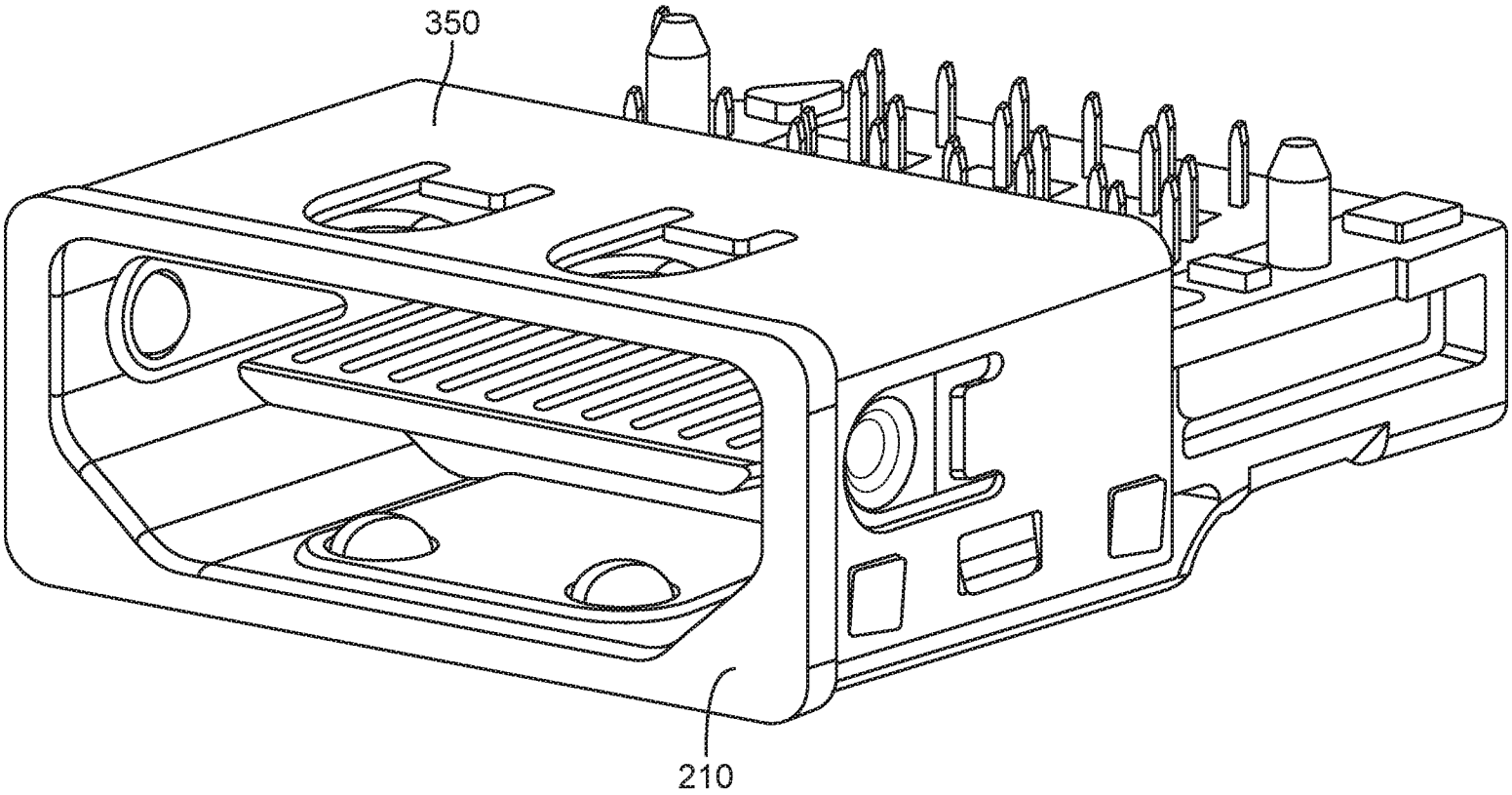
Figure 9:
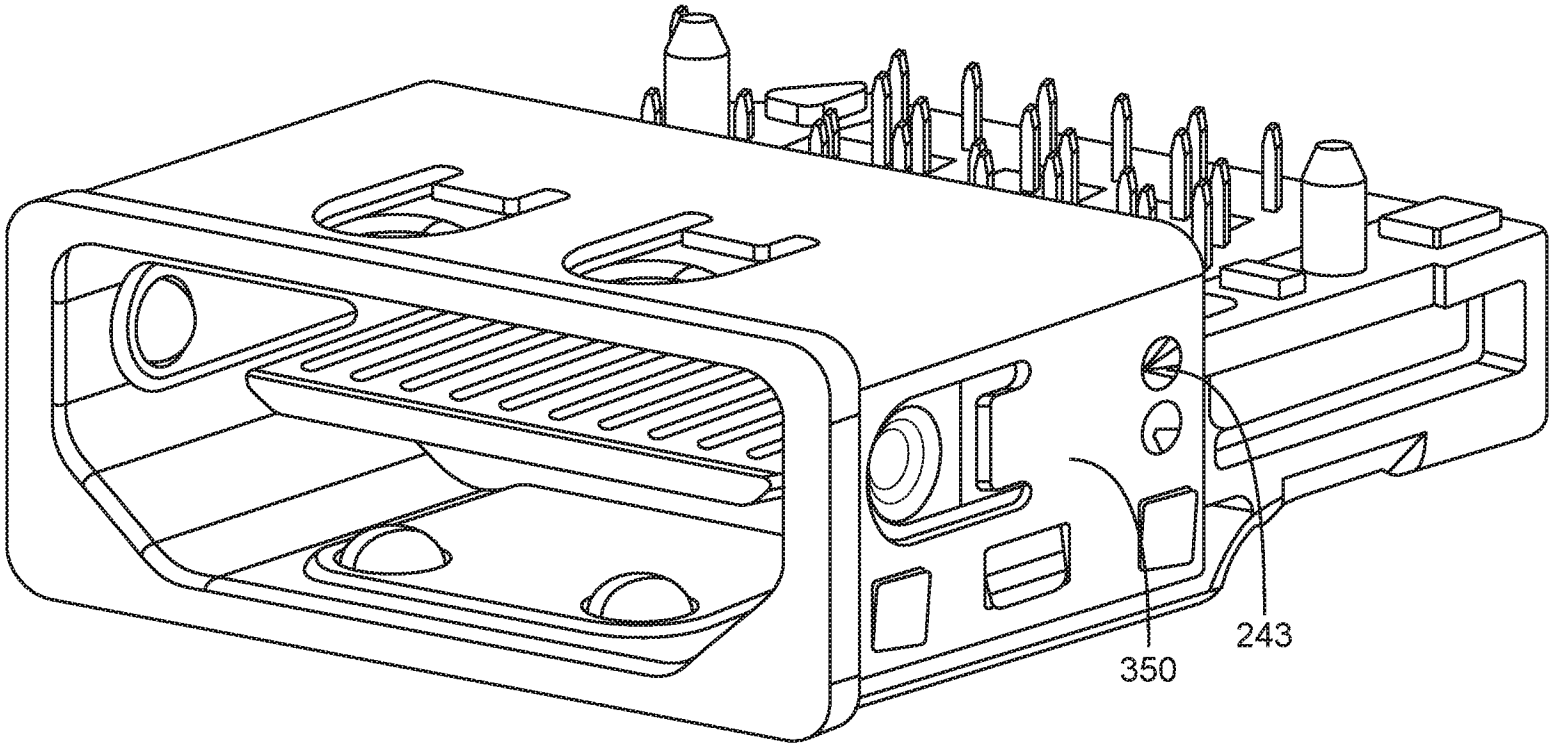
Figure 10:
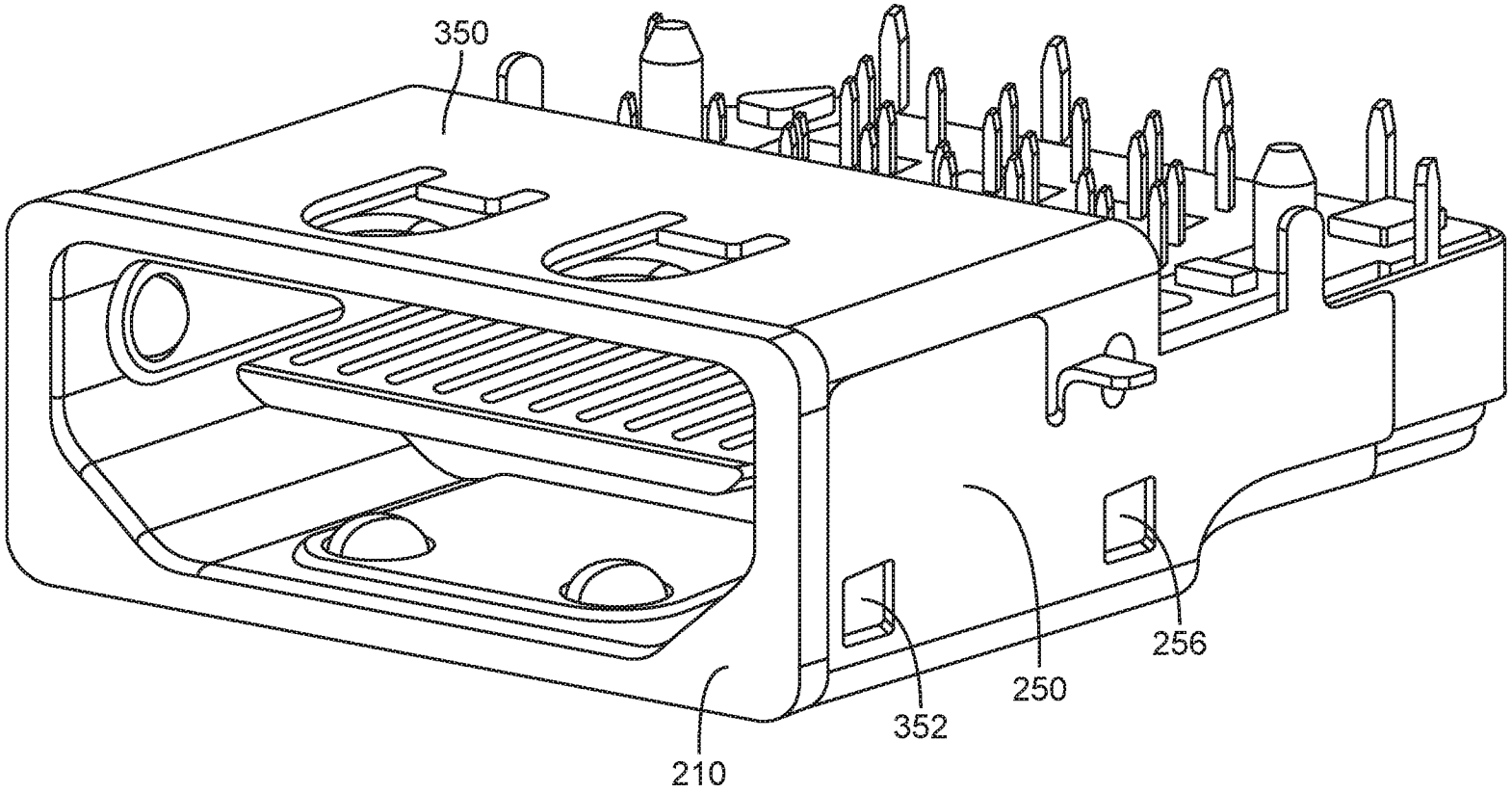

In FIG. 8, bottom shield 350 may be placed over a bottom surface and sides of housing 210. In FIG. 9, bottom shield 350 may be attached to beams 242 (as shown in FIG. 7) at points 243 by soldering or spot or laser welding. In FIG. 10, top shield 250 may be fit over a top surface and sides of housing 210. Openings 256 of top shield 250 may accept notches 352 on bottom shield 350. Top shield 250 and bottom shield 350 may be soldered or spot or laser welded together at various points.

Again, embodiments of the present invention may provide connector receptacles that are reliable and less susceptible to damage. For example, they may be less susceptible to damage that may occur during an insertion of a connector insert into the connector receptacle. One embodiment of the present invention may provide a plurality of contacts where the contacts are less prone to separate from a tongue or other housing portion. Since they are less likely to separate from the tongue or other housing portion, they may be less susceptible to being bent by a connector insert when the connector insert is inserted into the connector receptacle. Examples of such contacts are shown in the following figures.

Figure 11:
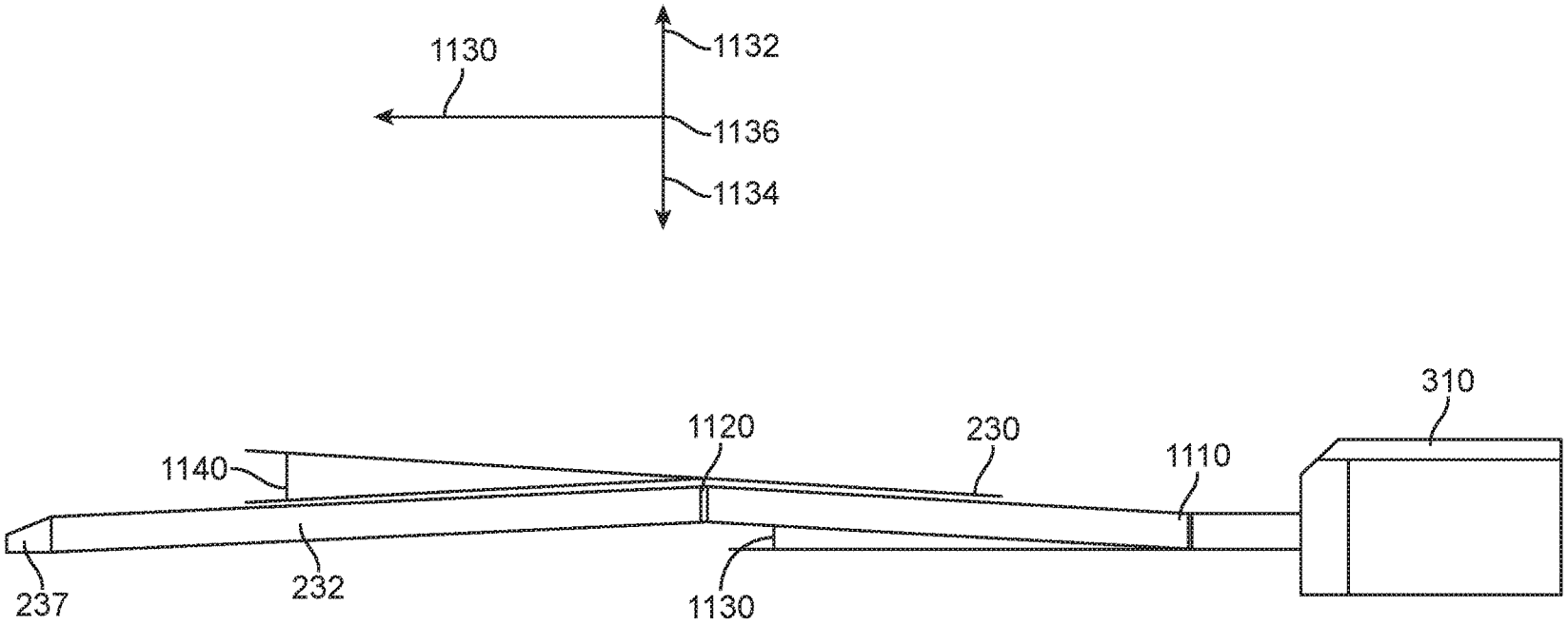
FIG. 11 illustrates a contact having one or more bends according to an embodiment of the present invention.

FIG. 11 illustrates a contact according to an embodiment of the present invention. In this example, contact 230 is partially supported by housing 310. Contacting portion 232 of contact 230 may include one or more bends. A first bend may be at location 1110, while a second bend may be at location 1120. The second bend at location 1120 may be between the first bend at location 1110 and a front of a connector receptacle or tip 237 of contact 230. In this example, contact 230 may extend generally in a lateral direction 1130 from a rear of a connector receptacle to a front of a connector receptacle. A first bend at location 1110 may be in generally in the direction 1132. The second bend at locations 1120 may be generally in the direction 1134. Direction 1134 may be opposite of direction 1132, and direction 1130 may be at least approximately orthogonal to directions 1132 and 1134. Contacts 230 may be in a line on a tongue, where the line of contacts 230 and the tongue extend laterally in a direction 1136 into the plane of FIG. 11, such that direction 1130 may be at least approximately orthogonal to directions 1132 and direction 1136.

In various embodiments of the present invention, the bends at locations 1110 and 1120 may have different magnitudes. For example, the first bend at location 1110 may form an angle 1130 of approximately 1, 2, 3, 4, or more than four degrees. The second bend at location 1120 may form angle 1140 that is approximately twice angle 1130. For example, angle 1140 may be approximately 2, 4, 6, 8 or more than 8 degrees. This combination of bends may increase an angle between contacting portion 232 and a tongue or other housing portion of a connector. This is shown in more detail in FIG. 16 below.

Again, embodiments of the present invention may provide connector receptacles that are readily manufactured. In one embodiment of the present invention, openings and a rear of tongues 220 (shown in FIG. 6) may include openings to allow for passage of contacting portions 232 of contacts 230. These openings may include lead-ins to prevent stubbing of the contacting portions 232 of contacts 230 during assembly. An example is shown in the following figures.

Figure 12:
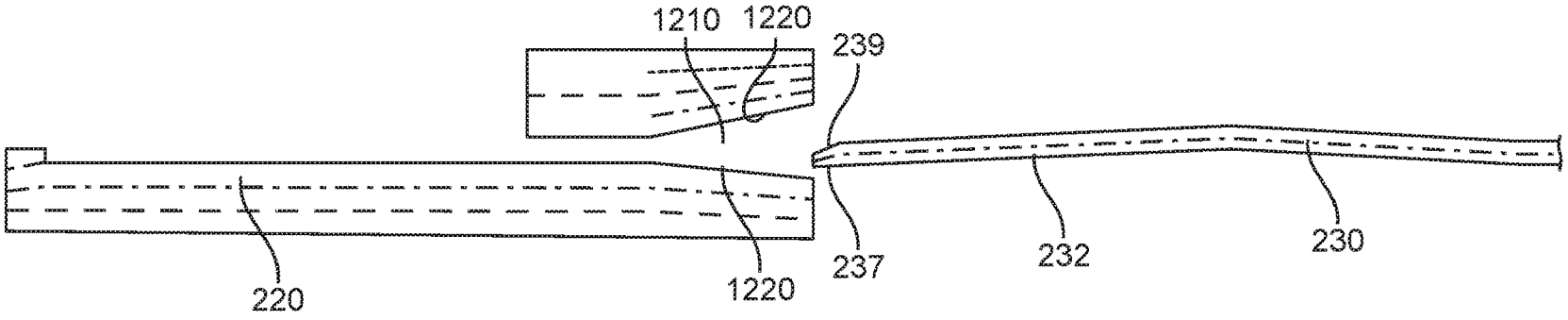
FIG. 12 illustrates a side view of a portion of the rear of a tongue for a connector receptacle according to an embodiment of the present invention.

FIG. 12 illustrates a side view of a portion of the rear of a tongue for a connector receptacle according to an embodiment of the present invention. This figure illustrates a rear of tongue 220 and contact 230 during the assembly of a connector receptacle. In this example, tongue 220 may include rear opening 1210. The rear opening 1210 may be defined by tapered lead-ins 1220. As contact 230 is inserted onto tongue 220, contacting portion 232 may pass through rear opening 1210. The tapered lead-ins 1220 may prevent stubbing of contact 230 and damage to contacting portions 232 of contacts 230 during their insertion. Tip 237 of contact 230 may have chamfered edge 239, which may further help to avoid stubbing contacts 230 during insertion though rear opening 1210.

Figure 13:
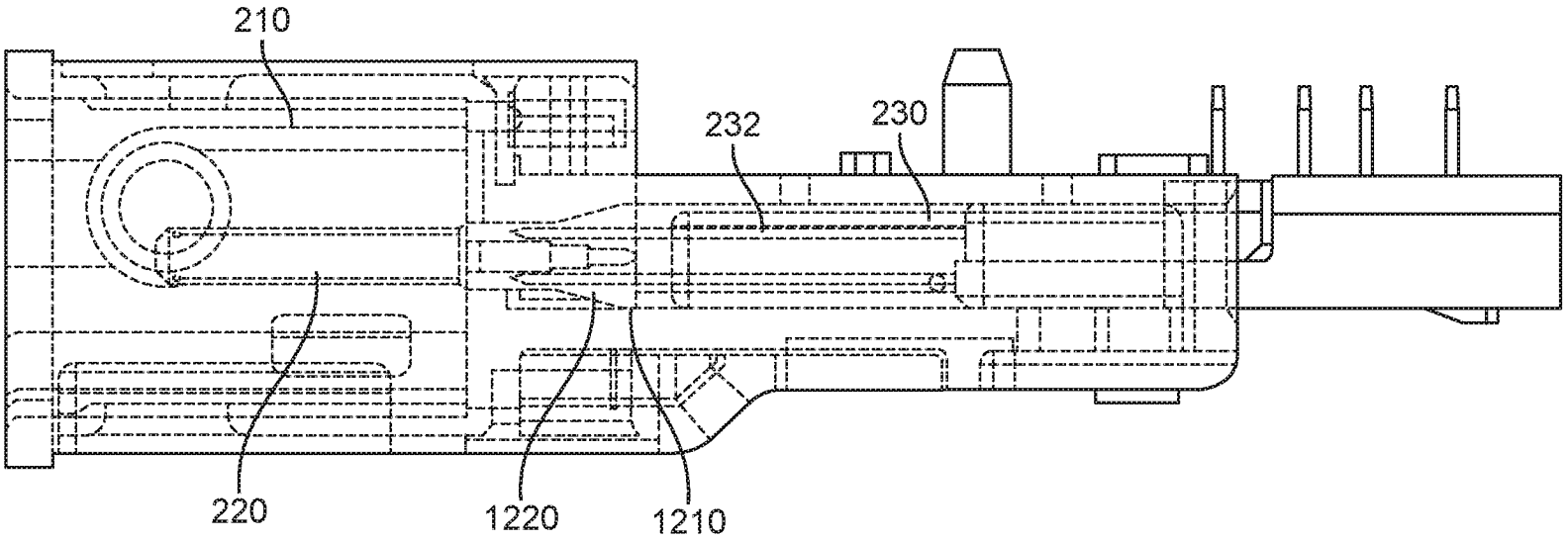
FIG. 13 illustrates a side view of a connector receptacle during assembly according to an embodiment of the present invention.

FIG. 13 illustrates a side view of a connector receptacle during assembly according to an embodiment of the present invention. Again, contacting portions 232 of contacts 230 may pass through openings 1210 in rear of tongue 220 in housing 210. Openings 1210 may have sloped or tapered lead-ins 1220 to facilitate the passage of contacting portions 232 during assembly.

Figure 14:
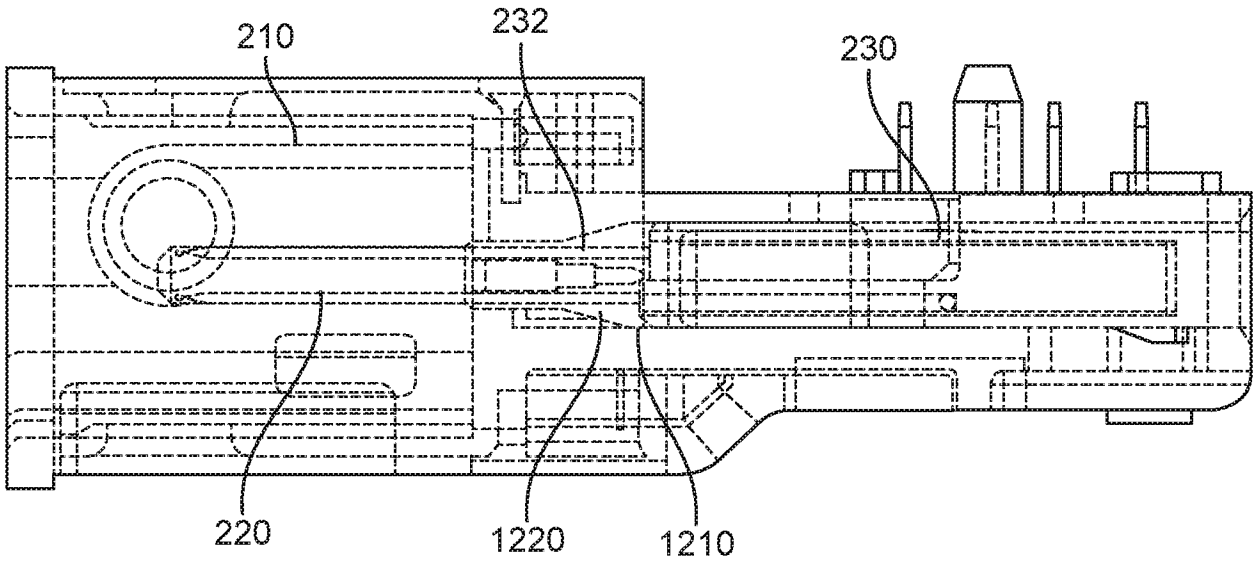
FIG. 14 illustrates another side view of a connector receptacle during assembly according to an embodiment of the present invention.

FIG. 14 illustrates another side view of a connector receptacle during assembly according to embodiments of the present invention. In this example, contacting portions 232 of contacts 230 are positioned on tongue 220 in housing 210 after having passed through openings 1210 having tapered lead-ins 1220.

Figure 15:
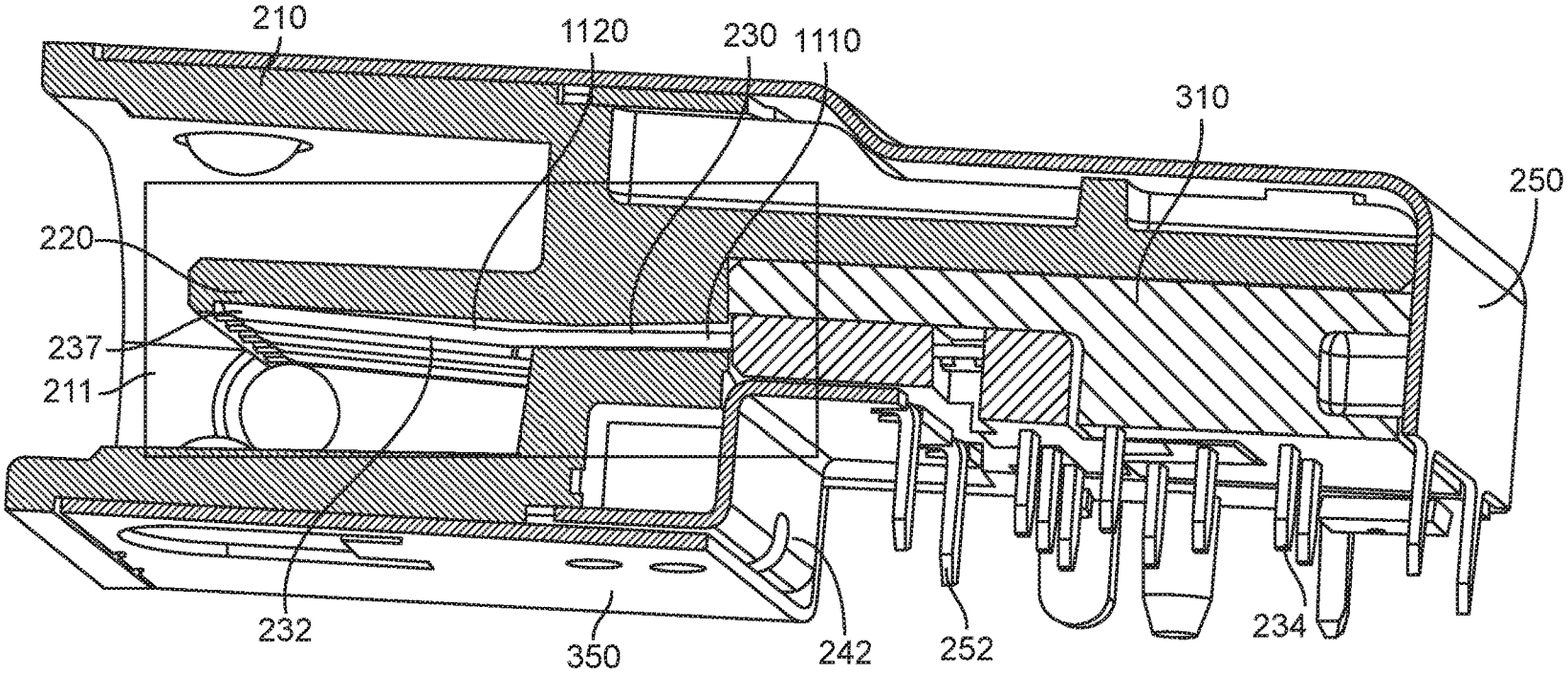
FIG. 15 illustrates a cutaway side view of a connector receptacle according to an embodiment of the present invention.

FIG. 15 illustrates a cutaway side view of a connector receptacle according to an embodiment of the present invention. A number of contacts 230 may be supported by rear housings 310. Contacts 230 may include contacting portions 232 and through-hole contact portions 234. Contacting portions 232 may be supported by tongue 220. Tongue 220 may be located in opening 211 in housing 210. Housing 210 may be shielded by bottom shield 350 and top shield 250.

Again, it may be desirable that contacts 230 are not damaged when a connector insert is inserted into this connector receptacle. Accordingly, contacts 230 may include a number of bends such that tip 237 of contact 230 is less likely to separate from tongue 220. In this particular embodiment, contacts 230 may include bends at locations 1110 and 1120. The bend at 1110 may be in a downward angle such that contacting portion 232 is further away from tongue 220 at location 1120. The second bend at location 1120 may angle contact 230 such that contact tip 237 may be adjacent to tongue 220. This may provide a pre-bias on contact 230 such that it tends to stay in contact with tongue 220. Contacting portions (not shown) on a top side of tongue 220 may follow a mirror image of contacting portions 232.

It may also be desirable to shield signals on contacts 230 from outside sources. Accordingly, contacting portions 232 may be shielded on a top and sides by top shield 250 and on a bottom and sides by bottom shield 350. Through-hole contact portions 234 may be shielded by tabs 252. Tabs 252 may be formed as part of, or connected to, top shield 250 or bottom shield 350. Tabs 252 may be indirectly connected to a shield through cross beam 242, or tabs 252 may be arranged in lines on each side of an array of through-hole contact portions 234, thereby shielding the array of through-hole contact portions 234.

Figure 16:
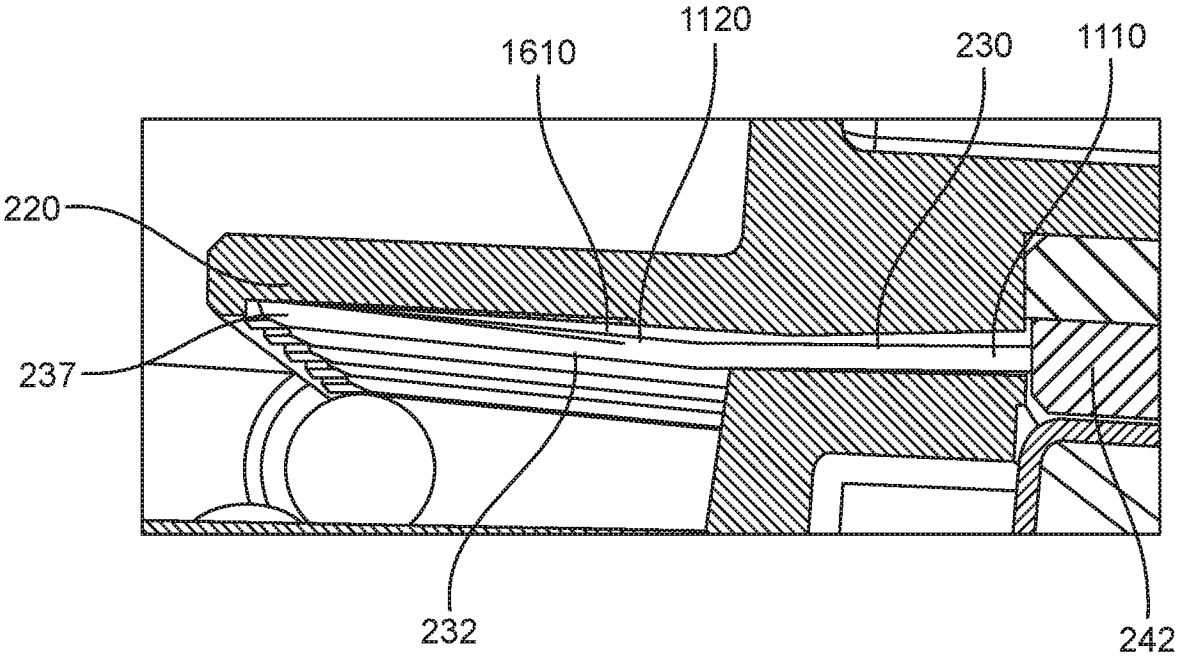
FIG. 16 illustrates a close-up view of a portion of a connector receptacle according to an embodiment of the present invention.

FIG. 16 illustrates a close-up view of a portion of a connector receptacle according to an embodiment of the present invention. Again, contacts 230 may reside on tongue 220 and be supported by housing 210 (shown in FIG. 15). Contacting portions 232 may include a downward bend 1110 angled away from tongue 220 and an upward bend 1120 angled towards tongue 220 such that tip 237 is held in position against tongue 220. This arrangement may also increase an angle 1610 of approach between contacting portion 232 and tongue 220. This increased angle of approach may provide a pre-bias to contact 230, which help to prevent contacting portion 232 from separating from tongue 220. Again, such a separation may allow a contact 230 to become bent during the insertion of a connector insert.

In other embodiments of the present invention, tongue 220 may be a tongue of a connector insert. For example, contacts 230 may include the same or similar bends as contacts for a connector insert. Also, in other embodiments of the present invention, contacts 230 may be located elsewhere in a connector receptacle or a connector insert. For example, contacts 230 may be located along a top or bottom side of a connector receptacle or connector insert opening. An example is shown in the following figure.

Figure 17:
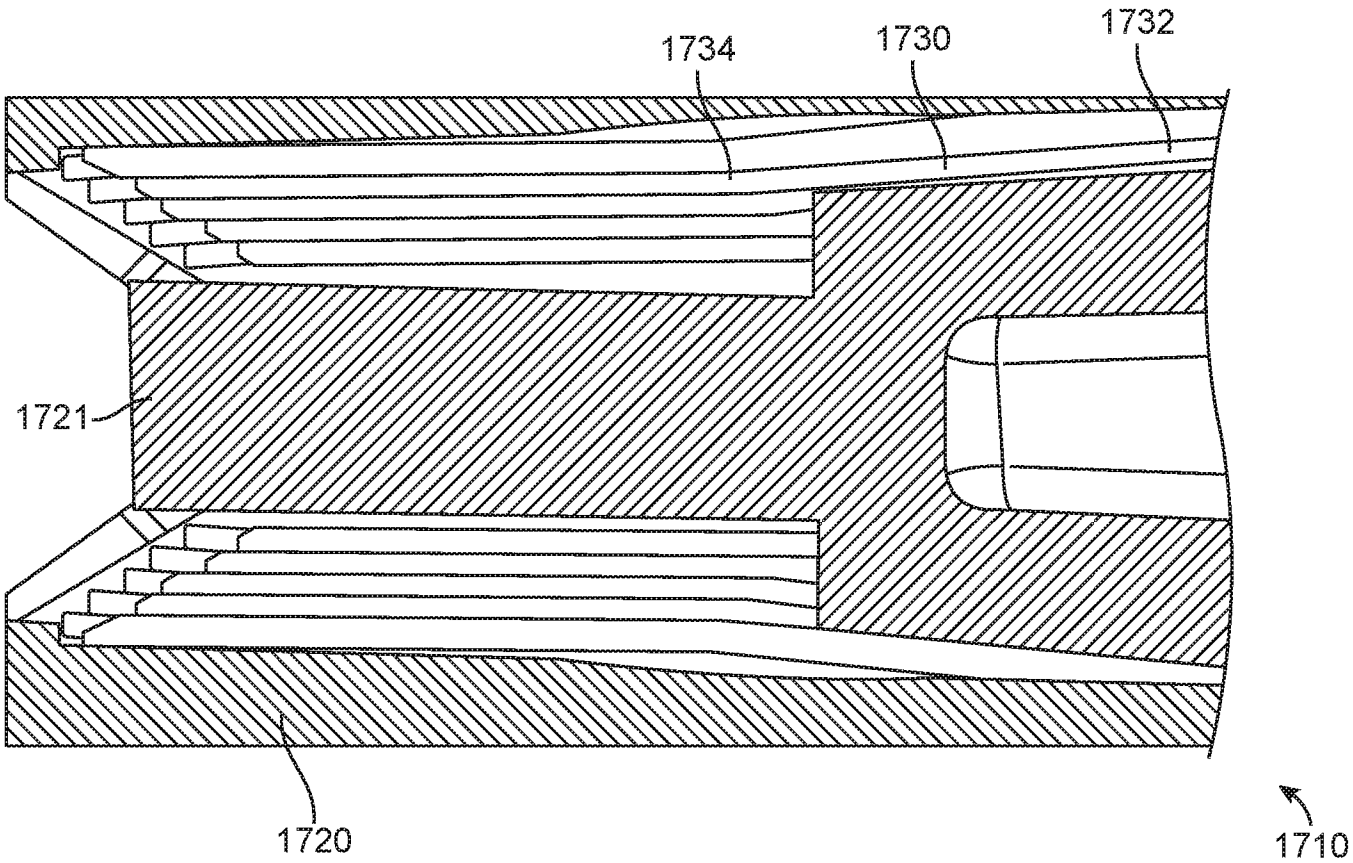
FIG. 17 illustrates a portion of a connector according to an embodiment of the present invention.

FIG. 17 illustrates a portion of a connector according to an embodiment of the present invention. Connector 1710 may be a portion of a connector receptacle or a connector insert. Connector 1710 may accept a tongue of a connector receptacle or a connector insert. This connector may include housing 1720 supporting a plurality of contacts 1730. Contacts 1730 may be located in housing 1720 along a top and bottom side of opening 1721. In this example, contacts 1730 may include a bend at location 1732 away from housing 1720 and bend at location 1734 towards housing 1720, where location 1734 is between location 1732 and a front of housing 1720.

Figure 18:
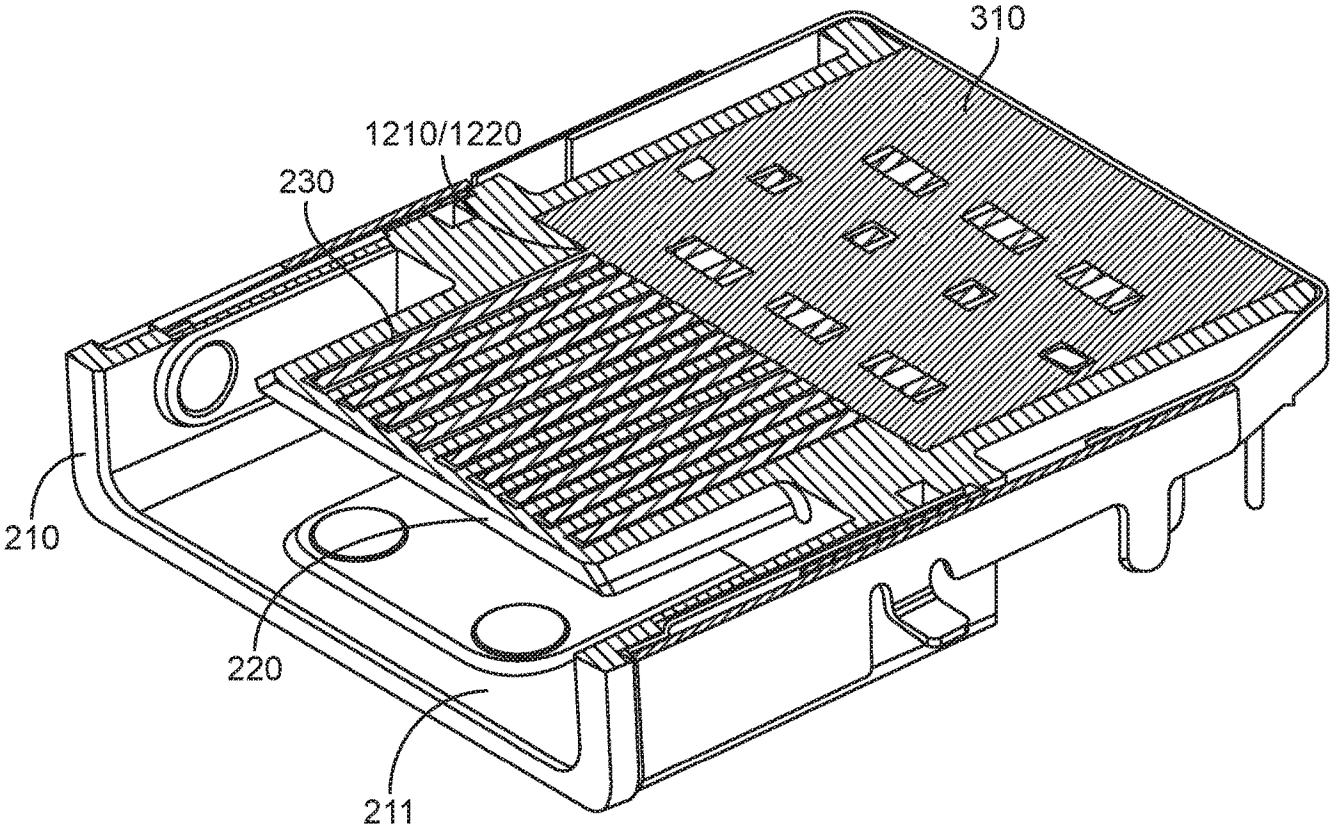
FIG. 18 illustrates a cutaway view of a connector receptacle according to an embodiment of the present invention.

FIG. 18 illustrates a cutaway view of a connector receptacle according to an embodiment of the present invention. This connector receptacle may include a tongue 220 in opening 211 of housing 210 supporting a number of contacts 230. Again, tongue 220 may be a tongue of a connector insert. In such a connector insert, housing 210 and its shields may be absent. During assembly, contacts 230 may be inserted through rear openings 1210 onto tongues 220. Openings 1210 may have tapered lead-ins 1220.

Modern screens, such as screen 132 in FIG. 1, may have very high resolutions. This may necessitate the transfer of data at very high bit rates between computer 110 or set-top box 140 and monitor 130. Accordingly, embodiments of the present invention may provide connector receptacles that may have an improved isolation between signal contacts signals in order to provide a high signal quality. An example is shown in the following figure.

Figure 19:
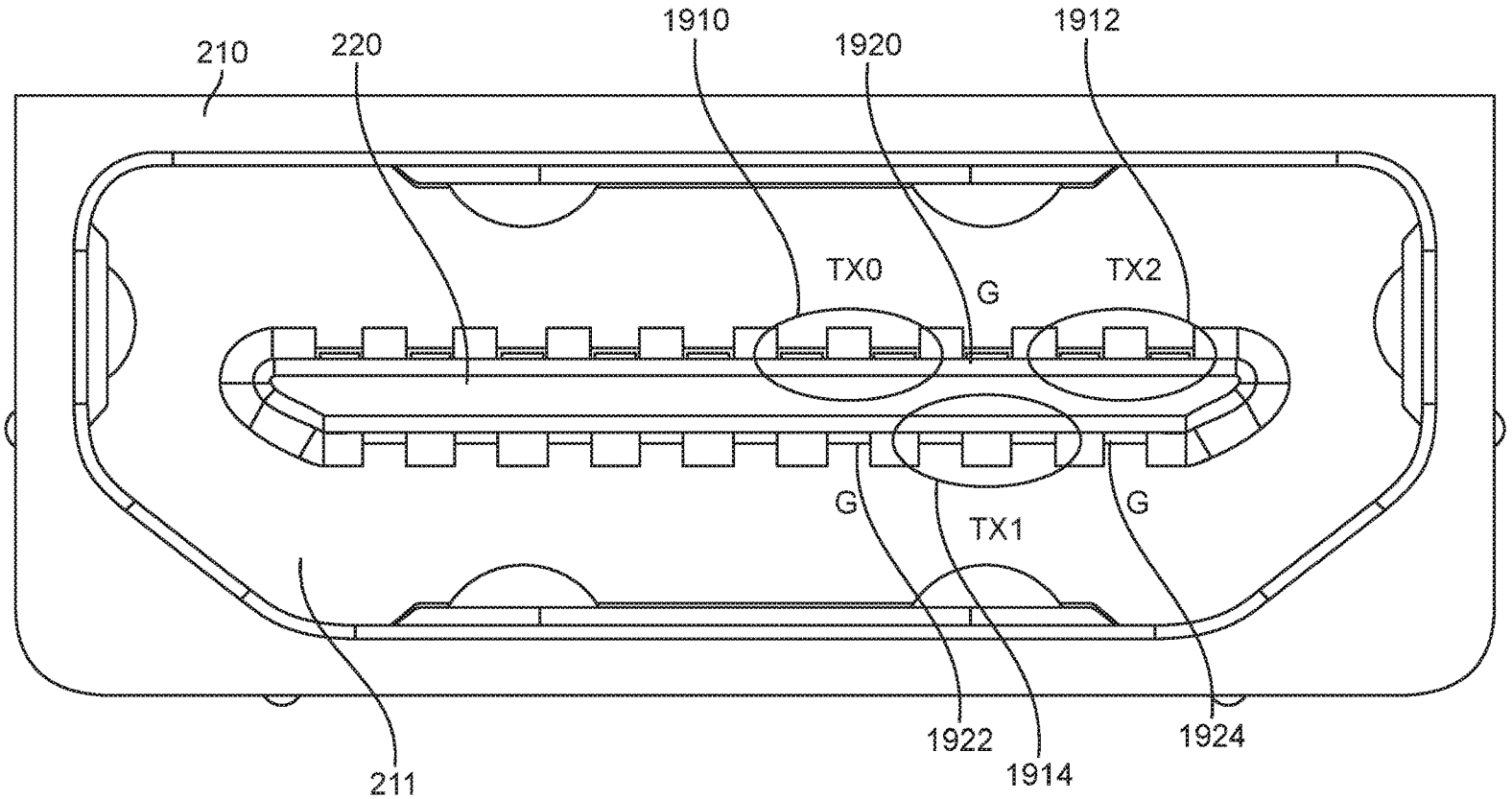
FIG. 19 illustrates a portion of a pinout for an HDMI connector.

FIG. 19 illustrates a portion of a pinout for an HDMI connector. This HDMI connector may include differential pairs TX0 1910, TX1 1914 and TX2 1912. These differential pairs may have individual shield contacts for ground, such as ground contacts 1922, 1920, and 1924.

Figure 20:
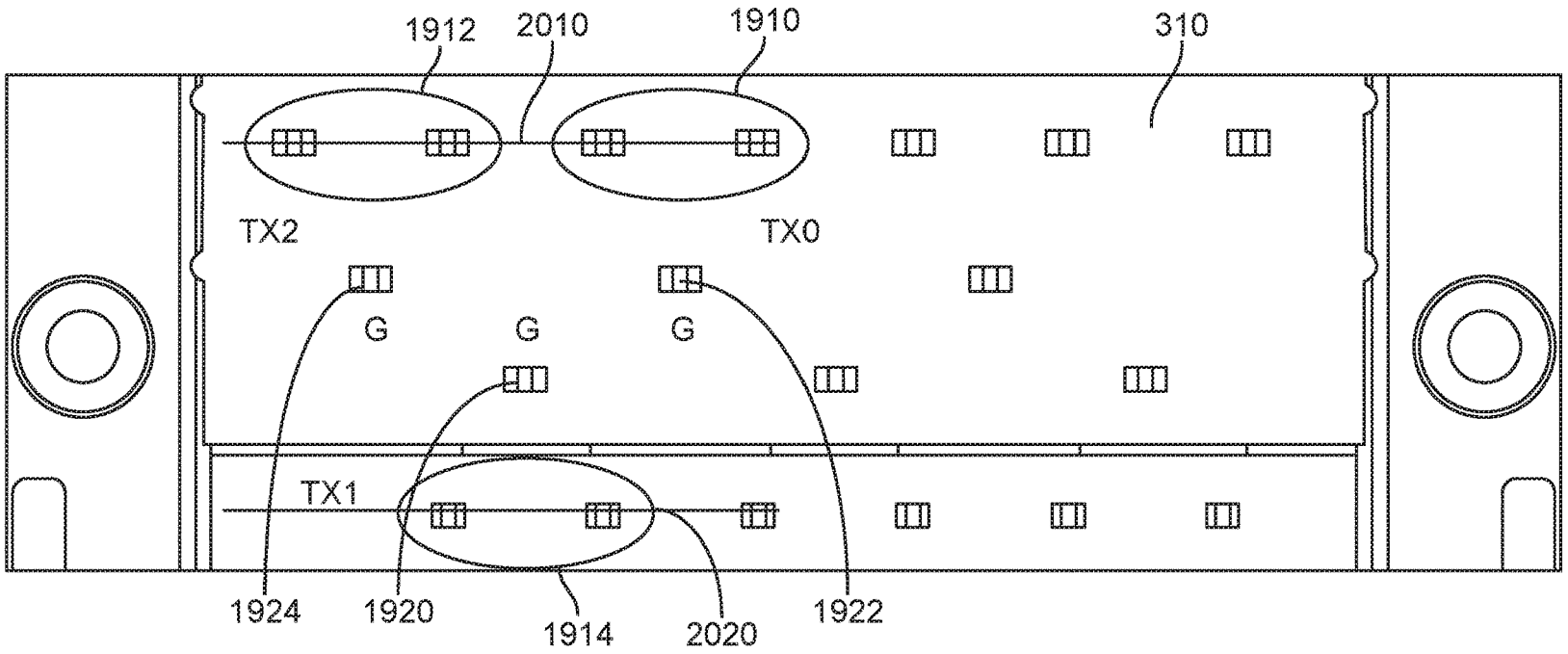
FIG. 20 illustrates positions of through-hole contact portions for the contacts illustrated in FIG. 19.

FIG. 20 illustrates positions of through-hole contact portions for the contacts illustrated in FIG. 19. These through-hole contact portions may be supported by housing 310. In this example, through-hole portions for differential pairs TX0 1910 and TX2 1912 may be arranged in the first line 2010. Through-hole contact portions for differential pair TX1 1914 may be arranged in a second line 2020. Ground contacts 1924, 1920, and 1922 may be positioned between the two lines 2010 and 2020. This may prevent cross coupling between the signals on the differential pair lines.

Figure 21:
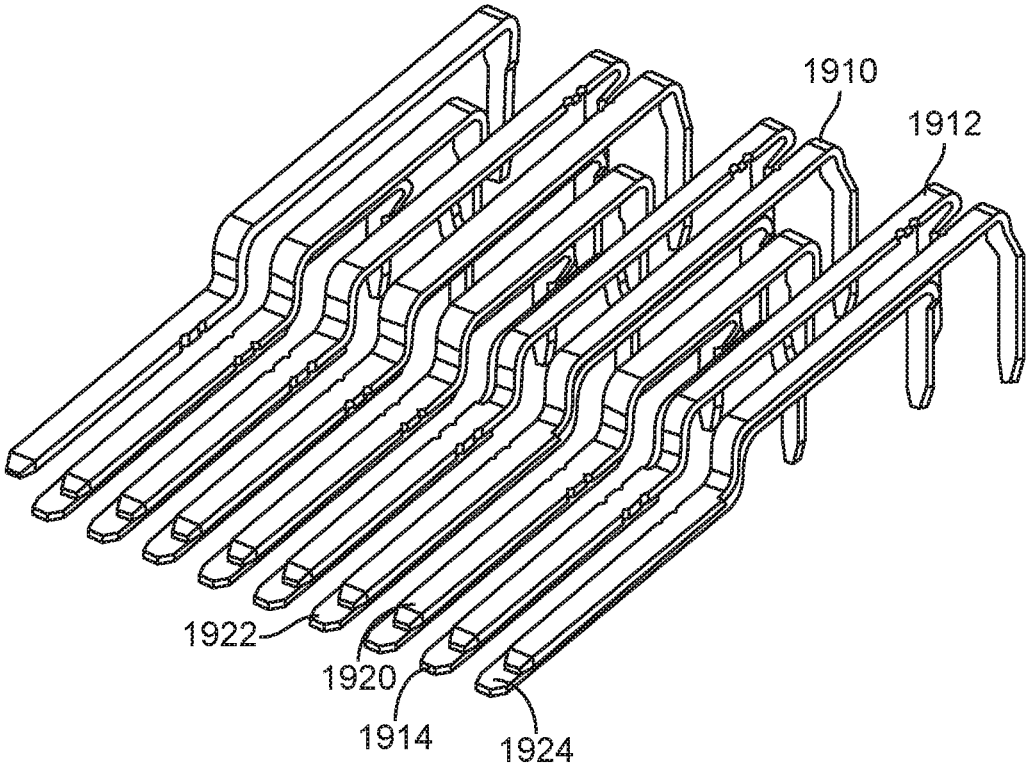
FIG. 21 illustrates contacts for a connector according to an embodiment of the present invention.

FIG. 21 illustrates contacts for a connector according to an embodiment of the present invention. These contacts may include signal contacts for differential pairs TX0 1910, TX2 1912, and TX1 1914, as well as their grounds 1922, 1920, and 1924. In this example, ground contact 1920 may extend between differential pair contacts TX0 1910 and TX2 1912 for a majority of their length. Ground contacts 1922 and 1924 may be positioned below differential pair contacts for TX0 1910 and TX2 1912 and on each side of contacts for differential pair TX1 1914. This arrangement may improve the separation and shielding among these differential pair contacts.

In these and other embodiments of the present invention, power supply and signal contacts may include through-hole contact portions. These through-hole contact portions may fit in openings in a printed circuit board or other appropriate substrate to form electrical connections with traces in the printed circuit board or other appropriate substrate. These through-hole contact portions may also provide mechanical stability for the combined connector receptacle. In other embodiments of the present invention, some or all of the contacts may terminate in surface-mount contacting portions.

While embodiments of the present invention may be useful in HDMI connector receptacles, these and other embodiments of the present invention may be used in other types of connector inserts and connector receptacles for different interfaces.

In various embodiments of the present invention, contacts, shields, EMI or ground contacts, beams, cross-beams, and other conductive portions of a connector receptacle or connector insert may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, rear housings, tongues, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material. Printed circuit boards may be replaced by other substrates, such as flexible circuit boards, in many embodiments of the present invention.

Embodiments of the present invention may provide connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these connector inserts and connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a housing having a front opening;

a plurality of contacts supported by the housing; and a tongue supporting contacting portions of the plurality of contacts, the contacting portions extending from a rear of the housing towards the front opening of the housing, wherein each contacting portion has a first bend to angle the contacting portion away from the tongue, and a second bend to angle the contacting portion towards the tongue, the second bend between the first bend and the front opening of the housing, and wherein the first bend and the second bend are arranged to pre-bias the contacting portions of the plurality of contacts such that they apply a force against the tongue.

2. The connector of claim 1 wherein the connector is a connector receptacle and the front opening accepts a connector insert when the connector insert is inserted into the connector receptacle.

3. The connector of claim 1 wherein the first bend forms an angle of approximately 3 degrees and the second bend forms an angle of approximately 6 degrees.

4. The connector of claim 1 wherein the contacts extend from a rear of the housing towards the front opening of the housing in a first direction, the tongue extends laterally in a second direction, the first bend angles the contacting portion in a third direction, and the second bend angles the contacting portion in a fourth direction, where the third direction and the fourth direction are opposite directions, and where the first, second, and third directions are orthogonal to each other.

5. The connector of claim 1 wherein the tongue and housing are formed as a single piece.

6. The connector of claim 5 wherein a rear of the tongue comprises a plurality of openings, each for a corresponding contact in the plurality of contacts.

7. The connector of claim 6 wherein each of the plurality of openings at the rear of the tongue has a tapered lead-in.

8. The connector of claim 7 wherein the connector is a High-Definition Multimedia Interface connector receptacle.

9. The connector of claim 8 wherein the plurality of contacts each comprise a through-hole contact portion, where through-hole contact portions for a first differential pair and a second differential pair are positioned in a first line, through-hole contact portions for a third differential pair are positioned in a second line, and where through-hole contact portions for ground contacts associated with the first differential pair, the second differential pair, and the third differential pair are positioned between the first line and the second line.

10. A connector comprising:

a housing having a front opening; and a first plurality of contacts, each having a contacting portion extending from a rear of the housing to the front opening in a first direction, the contacting portions arranged in a first line extending in a second direction, wherein the contacting portion of each of the first plurality of contacts includes a first bend to angle the contacting portion towards a third direction and a second bend to angle the contacting portion towards a fourth direction, the second bend between the first bend and the front opening of the housing, the third direction opposite the fourth direction, where the first direction, the second direction, and the third direction are orthogonal to each other; and a second plurality of contacts, wherein contacting portions for each of the second plurality of contacts are positioned on a bottom side of the front opening in the housing, wherein each contacting portion for each of the second plurality of contacts has a first bend towards the fourth direction to angle the contacting portion, and a second bend towards the third direction to angle the contacting portion, the second bend between the first bend and the front opening of the housing.

11. The connector of claim 10 further comprising a tongue, wherein the contacting portions of the first plurality of contacts are positioned on a first side of the tongue.

12. The connector of claim 11 further comprising the second plurality of contacts, wherein contacting portions for each of the second plurality of contacts are positioned on a second side of the tongue, wherein each contacting portion for each of the second plurality of contacts has the first bend towards the fourth direction to angle the contacting portion away from the tongue, and the second bend towards the third direction to angle the contacting portion towards the tongue, the second bend between the first bend and the front opening of the housing.

13. The connector of claim 11 wherein a rear of the tongue comprises a plurality of openings, each for a corresponding contacting portion of the first plurality of contacts, wherein each opening comprises a tapered lead-in.

14. The connector of claim 10 wherein the contacting portions of the first plurality of contacts are positioned along a top side of the front opening in the housing.

15. The connector of claim 10 further comprising the second plurality of contacts, wherein the connector is a High-Definition Multimedia Interface connector receptacle, and wherein the first plurality of contacts and second plurality of contacts each comprise a through-hole contact portion, where through-hole contact portions for a first differential pair and a second differential pair are positioned in a first line, through-hole contact portions for a third differential pair are positioned in a second line, where through-hole contact portions for ground contacts associated with the first differential pair, the second differential pair, and the third differential pair are positioned between the first line and the second line.

16. A connector comprising:

a plurality of contacts;

a housing; and a tongue supporting the plurality of contacts, wherein the plurality of contacts each comprise a through-hole contact portion, where through-hole contact portions for a first differential pair and a second differential pair are positioned in a first line, through-hole contact portions for a third differential pair are positioned in a second line, and where through-hole contact portions for ground contacts associated with the first differential pair, the second differential pair, and the third differential pair are positioned between the first line and the second line.

17. The connector of claim 16 wherein each of the plurality of contacts further comprises a contacting portion, wherein each contacting portion has a first bend to angle the contacting portion away from the tongue, and a second bend to angle the contacting portion towards the tongue, the second bend between the first bend and a front opening of the housing.

18. The connector of claim 17 wherein the plurality of contacts each extend from a rear of the housing towards the front opening of the housing in a first direction, the tongue extends laterally in a second direction, the first bend angles the contacting portion in a third direction, and the second bend angles the contacting portion in a fourth direction, where the third and fourth directions are opposite directions, and where the first, second, and third directions are orthogonal to each other.

19. The connector of claim 17 wherein a rear of the tongue comprises a plurality of openings, each for a corresponding contacting portion of the plurality of contacts, wherein each opening comprises a tapered lead-in.

* * * * *